US007347884B2

(12) United States Patent
Unami et al.

(10) Patent No.: US 7,347,884 B2
(45) Date of Patent: Mar. 25, 2008

(54) ALLOY STEEL POWDER FOR POWDER METALLURGY

(75) Inventors: Shigeru Unami, Chiba (JP); Naomichi Nakamura, Tokyo (JP); Satoshi Uenosono, Chiba (JP)

(73) Assignee: JFE Steel Corporation (JP)

( * ) Notice: Subject to any disclaimer, the term of this patent is extended or adjusted under 35 U.S.C. 154(b) by 334 days.

(21) Appl. No.: 10/918,887

(22) Filed: Aug. 16, 2004

(65) Prior Publication Data

US 2005/0039576 A1 Feb. 24, 2005

(30) Foreign Application Priority Data

Aug. 18, 2003 (JP) ..... 2003-294447
Apr. 21, 2004 (JP) ..... 2004-125010

(51) Int. Cl.
*B22F 3/00* (2006.01)
*B22F 1/00* (2006.01)

(52) U.S. Cl. ..... 75/246; 75/255

(58) Field of Classification Search ..... 75/255, 75/252, 246
See application file for complete search history.

(56) References Cited

U.S. PATENT DOCUMENTS 4,954,171 A * 9/1990 Takajo et al. ..... 75/246
5,049,183 A * 9/1991 Saka et al. ..... 75/244
6,610,120 B2 * 8/2003 Nakamura et al. ..... 75/255
2003/0056621 A1 * 3/2003 Nakamura et al. ..... 75/255

FOREIGN PATENT DOCUMENTS

| | | | | |
|---|---|---|---|---|
| JP | 50-10246 | B | | 4/1975 |
| JP | 59-215401 | A | | 5/1984 |
| JP | 61-130401 | A | | 6/1986 |
| JP | 63-137102 | | * | 6/1988 |
| JP | 63-66362 | B2 | | 12/1988 |
| JP | 6-81001 | A | | 3/1994 |
| JP | 6-89365 | B2 | | 11/1994 |
| JP | 7-51721 | B2 | | 6/1995 |
| JP | 7-233401 | A | | 9/1995 |
| JP | 07-331395 | | * | 12/1995 |
| JP | 8-49047 | A | | 2/1996 |
| JP | 2001-181701 | A | | 3/2001 |
| JP | 2002-146403 | | * | 5/2002 |
| JP | 2002-146403 | A | | 5/2002 |
| JP | 2002-327204 | A | | 11/2002 |
| JP | 2003-147405 | A | | 5/2003 |

* cited by examiner

*Primary Examiner*—Roy King
*Assistant Examiner*—Ngoclan T. Mai
(74) *Attorney, Agent, or Firm*—DLA Piper US LLP

(57) ABSTRACT

An alloy steel powder for powder metallurgy includes an iron-based powder containing about 0.5 mass percent or less of Mn as a prealloyed element and 0.2 to about 1.5 mass percent of Mo as a prealloyed element; and a Mo-containing alloy powder bonded on the surface of the iron-based powder by diffusion bonding. In the alloy steel powder for powder metallurgy, a Mo average content $[Mo]_T$ (mass percent) satisfies formula $0.8 \geqq [Mo]_T - [Mo]_P \geqq 0.05$, wherein the content $[Mo]_P$ is the above prealloyed Mo content (mass percent) in the iron-based powder.

26 Claims, 3 Drawing Sheets

ALLOY STEEL POWDER FOR POWDER METALLURGY

BACKGROUND

1. Technical Field

This disclosure relates to an alloy steel powder that can be used for powder metallurgy.

2. Description of the Related Art

Powder metallurgy technology allows components that require high dimensional accuracy and have a complex structure to be produced with near net shape, thereby significantly decreasing the finishing cost. Therefore, many products produced by powder metallurgy are used as various components for machines and apparatuses in many fields.

Recently, as components have been reduced in size and in weight, high rolling contact fatigue strength has been a strongly desired characteristic of iron-based powder metallurgy products.

In general, green compacts using an iron-based powder are produced as follows: An iron-based powder is mixed with powders for an alloy such as copper powder and graphite powder, and lubricant powders such as stearic acid and lithium stearate to prepare an iron-based mixed powder. This iron-based mixed powder is filled in a die and then subjected to compacting.

Iron-based powders are classified into, for example, iron powders (such as pure iron powders) and alloy steel powders depending on the component. Also, iron-based powders are classified into, for example, atomized iron powders and reduced iron powders depending on the method of production. In this case, "iron powders" also include alloy steel powders in a broad sense.

Green compacts produced by a general powder metallurgy process generally have a density of 6.6 to 7.1 $Mg/cm^3$. Subsequently, these green compacts of an iron-based powder are sintered to form sintered bodies. The sintered bodies are subjected to a sizing or a cutting process according to needs. Thus, powder metallurgy products are produced. Furthermore, the products are subjected to heat treatment such as carburizing or bright-quenching after sintering when higher rolling contact fatigue strength is required.

Applying a high alloy is useful for improving, for example, the tensile strength of the powder metallurgy product. In such a case, however, an alloy steel powder, which is a raw material, is hardened, thereby decreasing compressibility. Unfortunately, the load of the equipment in compacting is increased. In addition, the decrease in compressibility of the alloy steel powder offsets the increase in the strength because the density of the sintered body is decreased. Accordingly, a technology for increasing the strength of the sintered body and suppressing the decrease in the compressibility is desired.

According to a general technology for increasing the strength of the sintered body while maintaining compressibility, alloying elements such as Ni, Cu, and Mo, which improve hardenability, are added to the iron-based powder.

For example, according to Japanese Examined Patent Application Publication No. 63-66362, molybdenum (Mo) is used as an effective element for the above purpose. In the above patent document, Mo is added to an iron powder as a prealloyed element so long as compressibility is not impaired (Mo: 0.1 to 1.0 mass percent). Copper powders and nickel powders are bonded on the surfaces of the iron particles by diffusion bonding. According to this technology, both preferable compressibility during the compacting and high strength of the components after the sintering are obtained.

Japanese Unexamined Patent Application Publication No. 61-130401 discloses an alloy steel powder for powder metallurgy to produce a sintered body having high strength. According to the above patent document, at least two alloying elements, in particular, Mo and Ni, or Mo, Ni, and Cu, are bonded on the surfaces of steel powders by diffusion bonding. According to this technology, the concentrations of the alloying elements bonded on the surfaces of the steel powders by diffusion bonding are controlled as follows: The concentration of each alloying element bonded on the surfaces of fine steel powders having a diameter of 44 μm or less is controlled to be 0.9 to 1.9 times the concentration of each alloying element bonded on the surfaces of all steel powders. This relatively wide range of limitation provides a preferable impact toughness to the sintered body.

In view of the recent issues regarding environmental protection and recycling efficiency, however, the use of Ni and Cu has disadvantages and should be avoided as much as possible.

A Mo-containing alloy steel powder which does not contain Ni or Cu and in which Mo is the main alloying element is also disclosed. For example, an alloy steel powder disclosed in Japanese Examined Patent Application Publication No. 6-89365 includes 1.5 to 20 mass percent of Mo, which is a ferrite-stabilizing element, as a prealloy. In such a case, sintering is accelerated by forming a single a phase in which the self-diffusion rate of Fe is high. The use of this alloy steel powder provides a sintered body having a high density because of the matching of a step of pressure sintering with, for example, particle size distribution. In addition, the use of this alloy steel powder provides a homogeneous and stable structure because this powder does not include an alloying element bonded by diffusion bonding. However, the Mo content in the disclosure is relatively high, namely at least 1.8 mass percent. Unfortunately, in this alloy steel powder, compressibility is low and, therefore, a green compact having a high density cannot be produced. Consequently, when the green compact is subjected to a general sintering step (i.e., sintering in one step without pressurizing), the sintered body has a low density.

Japanese Unexamined Patent Application Publication No. 2002-146403 also discloses an alloy steel powder for powder metallurgy containing Mo as a main alloying element. According to this technology, 0.2 to 10 mass percent of Mo is bonded on the surface of iron-based powder by diffusion bonding, the iron-based powder containing 1.0 mass percent or less of Mn, or further containing less than 0.2 mass percent of Mo as the prealloy. This alloy steel powder has superior compressibility and provides a sintered body having a high density and high strength. However, a process of powder metallurgy that includes repressing and resintering of the sintered body is applied to this alloy steel powder. Therefore, a general method for sintering does not sufficiently provide the above advantage.

Japanese Examined Patent Application Publication No. 7-51721 discloses a ferroalloy powder (alloy steel powder) wherein 0.2 to 1.5 mass percent of Mo and 0.05 to 0.25 mass percent of Mn are added to an iron powder as prealloyed elements. This ferroalloy powder is a low alloy and has a relatively high compressibility in compacting. Furthermore, this ferroalloy powder provides a sintered body having high strength.

According to the technologies described above, however, the alloys are not designed to consider rolling contact fatigue strength. As described above, recently, high rolling contact fatigue strength is strongly desired in sintered metal components. Such high rolling contact fatigue strength is difficult to achieve, even when the above alloy steel powders are sintered by a general sintering step.

For example, the following problem resides in the ferroalloy powder disclosed in Japanese Examined Patent Application Publication No. 7-51721. When the ferroalloy powder is sintered at a temperature (in general, 1,120° C. to 1,140° C.) of a mesh belt furnace, which is generally used for powder metallurgy, the sintered body does not have a sufficiently high rolling contact fatigue strength. The reason for this is that the progress of sintering between the particles is not sufficiently accelerated and, therefore, the reinforcement of a sintering neck (i.e., a part where the sintering reaction starts, which will be described later) is insufficient.

For example, Japanese Unexamined Patent Application Publication Nos. 6-81001 and 2003-147405 disclose technologies in view of rolling contact fatigue strength. According to the technology disclosed in Japanese Unexamined Patent Application Publication No. 2003-147405, 0.5 to 1.5 mass percent of Mo is bonded on the surfaces of a steel powder containing 0.5 to 2.5 mass percent of Ni and 0.3 to 2.5 mass percent of Mo as the prealloy by diffusion bonding. The sintered body after carburizing and quenching has a maximum fatigue strength of about 2.5 GPa, which is measured by a Mori-type rolling contact fatigue tester. However, recently, higher rolling contact fatigue strength has been desired.

Japanese Unexamined Patent Application Publication No. 6-81001 discloses the following alloy steel powder. An iron-based powder contains 0.05 to 2.5 mass percent of Mo and at least one element selected from the group consisting of V, Ti, and Nb as the prealloy. Nickel and/or copper is bonded on the surface of the above iron-based powder by diffusion bonding. According to that alloy steel powder, the sintered body after carburizing and quenching only has a maximum rolling contact fatigue strength of about 260 $kgf/mm^2$ as measured by the Mori-type rolling contact fatigue tester.

Accordingly, in view of the above problems, it would be advantageous to provide an alloy steel powder for powder metallurgy that has high rolling contact fatigue strength even after sintering at a relatively low temperature, while maintaining high density of the sintered body (i.e., high compressibility of the alloy steel powder).

SUMMARY OF THE INVENTION

The alloy steel powder includes an iron-based powder containing about 0.5 mass percent or less of Mn as a prealloyed element and 0.2 to about 1.5 mass percent of Mo as a prealloyed element; and a Mo-containing alloy powder bonded on the surface of the iron-based powder. In the alloy steel powder, a Mo average content $[Mo]_T$ (mass percent) satisfies formula (1):

$$0.8 \geqq [Mo]_T - [Mo]_P \geqq 0.05 \quad (1)$$

wherein the content $[Mo]_P$ is the prealloyed Mo content (mass percent) in the iron-based powder.

The Mo-containing alloy powder is preferably bonded on the surface of the iron-based powder by diffusion bonding or with a binder. In particular, diffusion bonding is preferable in which partial diffusion is performed between the Mo-containing alloy powder and the iron-based powder at the boundary.

The Mo-containing alloy powder used in diffusion bonding is preferably produced by reducing a Mo-containing compound mixed with the iron-based powder. When the mixture of the Mo-containing compound and the iron-based powder is reduced, the Mo-containing compound is reduced on the surface of the iron-based powder to form a Mo-containing alloy powder. Concurrently, the Mo-containing alloy powder is effectively bonded by diffusion bonding on the surface of the iron-based powder.

A pure Mo metal powder and a powder prepared from a commercially available ferromolybdenum can also be used as the Mo-containing alloy powder.

In the alloy steel powder, a Mo average content $[Mo]_S$ (mass percent) in an alloy steel powder for powder metallurgy having a particle diameter of 45 μm or less (i.e., fine alloy steel powder) preferably satisfies formula (2):

$$1.5[Mo]_T \geqq [Mo]_S \quad (2).$$

As the ratio of the Mo-containing alloy powder that is actually bonded on the iron-based powder to the total Mo-containing alloy powder becomes higher, the ratio of the content $[Mo]_S$ to the content $[Mo]_T$, i.e., $[Mo]_S/[Mo]_T$ decreases and is close to about 1. This value $[Mo]_S/[Mo]_T$ is hereinafter referred to as "Mo adhesion." The Mo adhesion is preferably about 1.2 or less. The lower limit of the Mo adhesion is preferably about 0.9, more preferably 1.0.

The iron-based powder preferably includes iron and inevitable impurities in addition to the above prealloyed elements.

In principle, the powder to be bonded on the iron-based powder is only Mo-containing alloy powder. Before compacting, however, other components such as a powder for an alloy or a lubricant may be further bonded with, for example, a binder.

The alloy steel powder is suitable as a raw material to produce sintered components having high density. In particular, the sintered body has high rolling contact fatigue strength even when the alloy steel powder is sintered at a relatively low temperature, for example, using a mesh belt furnace.

DETAILED DESCRIPTION

An alloy steel powder will now be described in detail with reference to the drawings.

Figure 1:
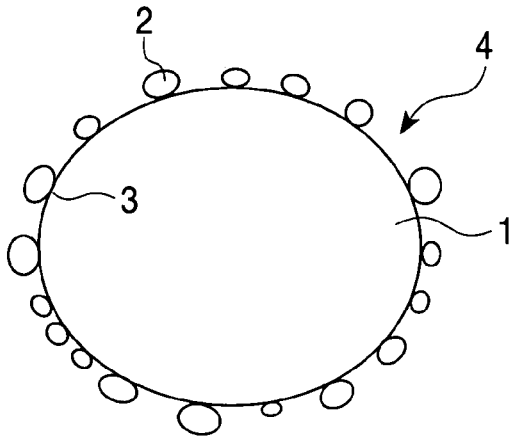
FIG. 1 is a schematic sectional view showing an example of an alloy steel powder according to aspects of the invention.

Referring to FIG. 1, a particle of an alloy steel powder 4 is shown. A particle of a Mo-containing alloy powder 2 is in contact with a particle of an iron-based powder 1 at a boundary 3. A part of Mo in the particle of the Mo-containing alloy powder 2 is diffused in the particle of the iron-based powder 1 at the boundary 3 (i.e., partial diffusion). Thus, the Mo-containing alloy powder 2 is bonded on the surface of the particle of the iron-based powder 1 (this bonding is hereinafter referred to as "diffusion bonding").

Unless otherwise stated, "iron-based powder" refers to an iron-based powder on which the MO-containing alloy powder is to be bonded as illustrated in FIG. 1, and an iron-based powder used as a raw material thereof. Both of the iron-based powders are distinguished according to need. Unless otherwise stated, "alloy steel powder" refers to a powder as illustrated in FIG. 1. That is, the alloy steel powder is substantially composed of particles of the alloy steel powder in which the Mo-containing alloy powder is bonded on the iron-based powder.

An example of a manufacturing process of the alloy steel powder will now be described.

Figure 2:
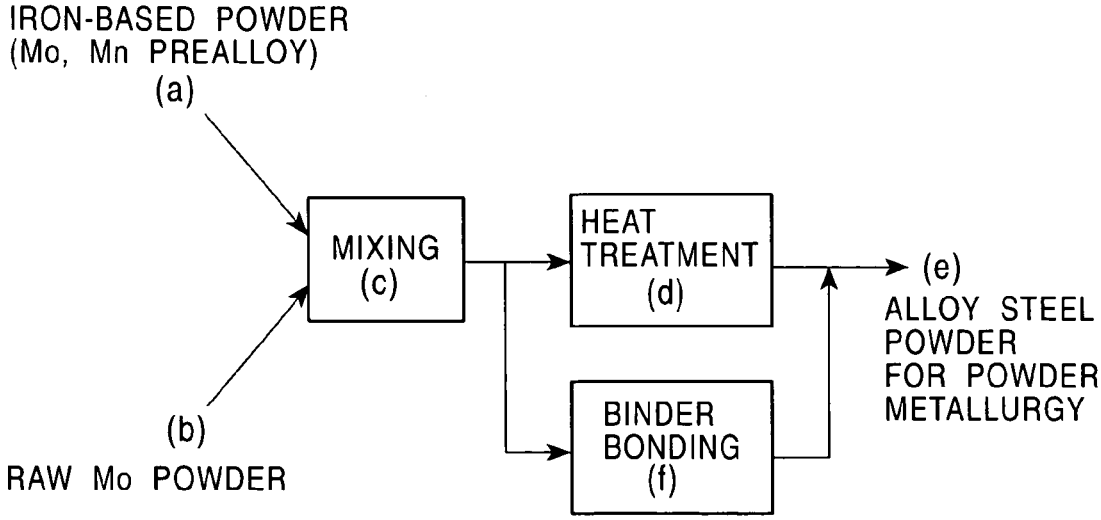
FIG. 2 is a block diagram showing an example of a manufacturing process of an alloy steel powder according to aspects of the invention.

Referring to an example of a manufacturing process (block diagram) shown in FIG. 2, first, an iron-based powder (a) (e.g., raw material of an iron-based powder), and a raw Mo powder (b) (e.g., raw material of a Mo-containing alloy powder) are prepared. The iron-based powder (a) contains predetermined amounts of Mo and Mn as alloy components in advance, i.e., as the prealloy.

The iron-based powder (a) is preferably an atomized iron powder. The atomized iron powder is produced by atomizing molten steel containing desired alloy components with water or gas. Thus, an iron-based powder is produced. The atomized iron powder is generally heated after atomization in a reducing atmosphere (for example, in hydrogen) to decrease C and O in the iron powder. However, an atomized iron powder without such heat treatment, i.e., "as atomized" powder, may be used as the iron-based powder (a).

In addition, other iron powders such as a reduced iron powder, an electrolytic iron powder, and a crushed iron powder may be used so long as the composition is matched.

In addition to a Mo-containing alloy powder itself, a Mo-containing compound that can form the Mo-containing alloy powder by reduction may be used as the raw Mo powder (b). However, both the Mo-containing alloy powder and Mo-containing compound do not substantially include a metal element other than Mo and Fe.

The Mo-containing alloy powder used as the raw Mo powder (b) includes a pure Mo metal powder and a powder prepared from a commercially available ferromolybdenum.

The Mo-containing compound includes Mo oxides, Mo carbide, Mo sulfides, Mo nitrides, and composites thereof. Mo oxides are preferably used in view of availability and facilitating the reductive reaction. The Mo-containing compound has a powder shape or is processed to have a powder shape by, for example, mixing with iron-based powder and reduction. The main component of the Mo-containing alloy powder prepared by reducing the Mo-containing compound is Mo or Mo-Fe.

In any case, any process such as crushing or atomization may be used so that the raw Mo material has a powder shape.

Subsequently, the iron-based powder (a) and the raw Mo powder (b) are subjected to mixing (c) at a predetermined ratio. The mixing (c) includes any available method, for example, using a Henschel mixer or a cone mixer.

In the diffusion bonding of the raw Mo powder (b), for example, about 0.1 mass percent or less (to the mixed powder) of a spindle oil may be added to improve the adhesion property between the iron-based powder (a) and the raw Mo powder (b). At least about 0.005 mass percent of the spindle oil is preferably added to achieve the desired effect.

The above mixture is maintained at a high temperature (i.e., heat treatment (d)) to perform the diffusion bonding. The molybdenum is diffused in the iron at the boundary between the iron-based powder (a) and the raw Mo powder (b) to produce an alloy steel powder for powder metallurgy (e) of the invention.

The heat treatment (d) is preferably performed in a reducing atmosphere. An atmosphere containing hydrogen, in particular, hydrogen atmosphere is preferred. The heat treatment (d) may be performed in a vacuum. The heat treatment (d) is preferably performed at about 800° C. to about 1,000° C.

The "as atomized" powder, has a high content of C and O. Therefore, when the "as atomized" iron powder is used as the iron-based powder (a), the heat treatment (d) is preferably performed in a reducing atmosphere to decrease the carbon and oxygen content. This treatment activates the surface of the iron-based powder. Consequently, diffusion bonding of the Mo-containing alloy powder can be reliably performed even at a low temperature (about 800° C. to about 900° C.). Accordingly, the atomized iron powder without heat treatment is preferably used as the iron-based powder (a), which is a raw material of the alloy steel powder, compared with an atomized iron powder in which the carbon and the oxygen in the powder is decreased by heat treatment in advance. The preferred content of carbon and oxygen will be described later with the content of other elements.

One aspect of the alloy steel powder, which is schematically shown in FIG. 1, is produced by the above method. Needless to say, when a Mo-containing alloy powder is used as the raw Mo powder, diffusion bonding is performed between the Mo-containing alloy powder 2 and the iron-based powder 1.

On the other hand, when a Mo-containing compound is used as the raw Mo powder, diffusion bonding is performed between a Mo-containing alloy powder 2 generated by reducing the Mo-containing compound and the iron-based powder 1. For example, when a Mo oxide is used as the raw Mo powder, the Mo oxide is reduced to form a Mo-containing alloy powder 2 (i.e., Mo metal powder) on the surface of the iron-based powder 1 in the heat treatment. Consequently, diffusion bonding is performed between the Mo-containing alloy powder 2 generated by reduction and the iron-based powder 1, as in the case where the Mo-containing alloy powder 2 itself is used as the raw Mo powder.

A Mo-containing compound is preferably used as the raw Mo powder, compared with the Mo-containing alloy powder in consideration of adhesion, i.e., the degree of adhesion. The reason for this is as follows: The surface of the Mo-containing alloy powder 2 reduced in the heat treatment becomes active to the diffusion-reaction. Consequently, adhesion to the iron-based powder 1 is improved.

Alternatively, as shown by the arrows in the branch in FIG. 2, the Mo-containing alloy powder 2 may be bonded on the surface of the iron-based powder 1 by a binder (hereinafter referred to as "binder bonding" (f)) instead of diffusion bonding by the heat treatment (d).

Any known binder may be used. Examples of the binder include metallic soaps such as zinc stearate and calcium stearate, and amide waxes such as ethylenebisstearamide and stearic acid monoamide. In particular, the above binder is preferably used because the binder also has a lubricating function. A binder that does not have a highly lubricating function, for example, polyvinyl alcohol (PVA), ethylene vinyl acetate copolymer, and phenolic resin may also be used. The lubricating function refers to a function in compacting, i.e., a function to increase the density of the green compact by accelerating the rearrangement of the powder, or a function to decrease the ejection force.

The Mo-containing alloy powder is bonded on the surface of the iron-based powder by heating the binder at the melting point (including the eutectic point) or more. The method for bonding with the binder is not limited to the above. For example, the binder may be dissolved in a solvent, and the solution may be applied on the Mo-containing alloy powder. The Mo-containing alloy powder may be bonded on the surface of the iron-based powder, and then the solvent may be evaporated.

The binder preferably includes a component having a melting point of about 80° C. to about 150° C. when the above binder such as a metallic soap is used. Then, the binder is heated at the melting point or more to bond the Mo-containing alloy powder.

After the heat treatment (d), which includes a treatment of diffusion bonding, in general, the iron-based powder 1 and the Mo-containing alloy powder 2 are sintered and coagulated. The coagulated powder is crushed and classified so that the powder has a desired particle diameter. The powder is annealed according to need, thereby producing a product of the alloy steel powder for powder metallurgy (e). A sintered body using this alloy steel powder produced by diffusion bonding generally has a rolling contact fatigue strength higher than that of a sintered body using an alloy steel powder produced by binder bonding.

On the other hand, the alloy steel powder for powder metallurgy (e) produced by binder bonding does not require crushing and classification. Therefore, alloy steel powder produced by binder bonding is advantageous in view of its low cost of manufacture.

The method for bonding the Mo-containing alloy powder 2 on the surface of the iron-based powder 1 is appropriately selected from diffusion bonding and binder bonding, depending on the application and specification of the alloy steel powder.

As shown in the concept of the Mo adhesion (i.e., degree of Mo adhesion), which will be described later in detail, a part of the Mo-containing alloy powder that is added or generated for the purpose of bonding remains in the alloy steel powder, the remaining Mo-containing alloy powder not being bonded on the surface of the iron-based powder (i.e., in a free state). The amount of such a Mo-containing alloy powder in the free state is preferably small. However, the harmful effects due to the Mo-containing alloy powder in the free state are limited insofar as the amount of the free powder is within the level results from the general bonding treatments as described above.

The method for bonding is not limited. Any method that can achieve a Mo adhesion comparable to that by the above methods may be used.

The reason for limiting the content of the alloying elements in the alloy steel powder 4 of the invention will now be described.

According to the alloy steel powder, a Mo content $[Mo]_P$ that is contained in the iron-based powder 1 as a prealloy, i.e., as an alloy component in advance, is 0.2 to about 1.5 mass percent to the mass of the alloy steel powder 4. The effect of improving the quenching property is not changed significantly even when the Mo content as the prealloy exceeds about 1.5 mass percent. In such a case, the compressibility of the alloy steel powder decreases due to hardening of the alloy steel powder 4. A Mo content that exceeds about 1.5 mass percent is economically disadvantageous. On the other hand, in the case that the Mo content as the prealloy is less than 0.2 mass percent, the following disadvantage occurs when the alloy steel powder is compacted and sintered to prepare the sintered body. Even though the sintered body is subjected to quenching hardening (for example, carburizing and quenching), a ferrite phase is readily formed. Accordingly, an increase in the strength and the rolling contact fatigue strength is difficult to achieve even if the sintered body is subjected to heat treatment.

The Mn content that is contained in the iron-based powder 1 as a prealloy is about 0.5 mass percent or less to the mass of the alloy steel powder 4. When the Mn content as the prealloy exceeds about 0.5 mass percent, the particle of the iron-based powder 1 is unintentionally hardened and, therefore, the density of the green compact is not increased. In addition, a strong affinity of Mn to oxygen causes oxidation during sintering or oxidation at the grain boundary during gas carburizing. Consequently, the rolling contact fatigue strength decreases. Accordingly, the Mn content that is contained in the iron-based powder 1 as a prealloy is controlled to about 0.5 mass percent or less, preferably, about 0.3 mass percent or less.

Since Mn has some amount of strengthening effect, Mn may be intentionally contained within the above range. The lower limit of the Mn content need not be determined in view of the material quality. However, in view of the cost of manufacture, the lower limit is industrially about 0.04 mass percent, although it may be lower, such as preferably about 0.02 mass percent.

As described above, the iron-based powder 1 contains Mo and Mn as the prealloy. In the alloy steel powder 4, the Mo-containing alloy powder 2 is bonded on the surface of the iron-based powder 1 by diffusion bonding, or by binder bonding. Furthermore, the Mo content as a prealloy $[Mo]_P$ (mass percent) and a Mo average content $[Mo]_T$ (mass percent) satisfy the following formula (1):

$$0.8 \geqq [Mo]_T - [Mo]_P \geqq 0.05 \quad (1).$$

In formula (1), the formula $[Mo]_T - [Mo]_P$ substantially means a Mo content that is bonded on the surface of the iron-based powder 1 by diffusion bonding or by binder bonding (wherein the loss due to the Mo-containing alloy powder in the free state is ignored). In the case of diffusion bonding, the formula $[Mo]_T - [Mo]_P$ refers to the amount of diffusion bonding, and in the case of binder bonding, the formula $[Mo]_T - [Mo]_P$ refers to an additional amount. Hereinafter until just before the Examples, the formula "$[Mo]_T - [Mo]_P$" refers to the amount of diffusion bonding, which includes the formula $[Mo]_T - [Mo]_P$ in the case of binder bonding.

The rolling contact fatigue strength of the sintered body is increased when the composition of the prealloy is within the above range, and the amount of Mo diffusion bonding, i.e., the amount of diffusion bonding of Mo, is within the range represented by formula (1). We believe that the reason for this is as follows.

Figure 3:
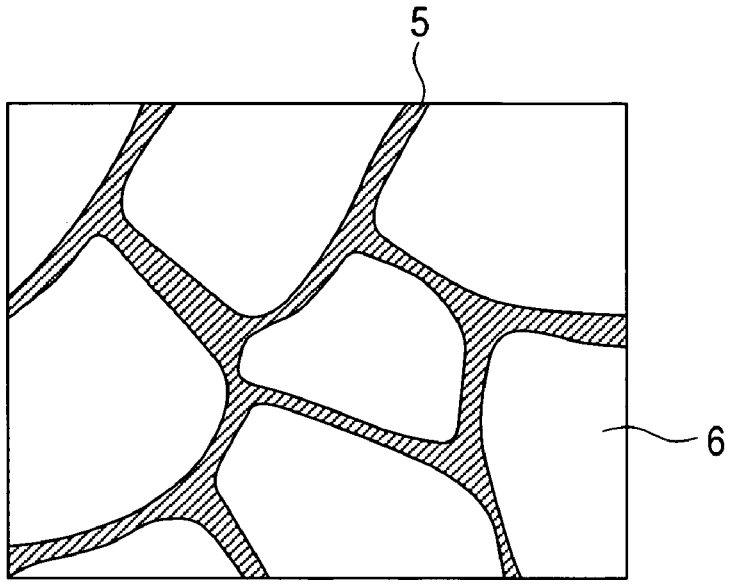
FIG. 3 is a schematic sectional view showing a typical example of a network structure of a sintered body.

FIG. 3 schematically shows a characteristic structure of a sintered body using an alloy steel powder. This structure, which is often observed in the sintered body, is hereinafter referred to as a "network structure."

Referring to FIG. 3, in the network structure, a Mo-rich phase 5 is formed at the periphery of a Mo-poor phase 6 with a network shape. The Mo-poor phase 6 is a host phase, i.e., a matrix, of the sintered body, which is based on the iron-based powder 1 containing Mo and Mn as the prealloy. This matrix is referred to as the "Mo-poor phase" 6 to distinguish it from the Mo-rich phase 5.

We believe that the network structure is formed according to the following mechanism. In the alloy steel powder 4, the Mo-containing alloy powder 2 is bonded by diffusion bonding on the surface of the iron-based powder 1 containing Mo and Mn as the prealloy. A green compact is formed using the alloy steel powder and then sintered. During sintering, the concentration of Mo becomes high at a sintering neck, which will be described later, between the particles of the iron-based powder 1. Accordingly, a single α phase is formed at the sintering neck. Consequently, sintering is accelerated to reinforce the sintering neck. A tough network structure is formed in the sintered body by controlling the amount of diffusion bonding of Mo within the range of the invention. This tough network structure improves the rolling contact fatigue strength of the sintered body.

Figure 5:
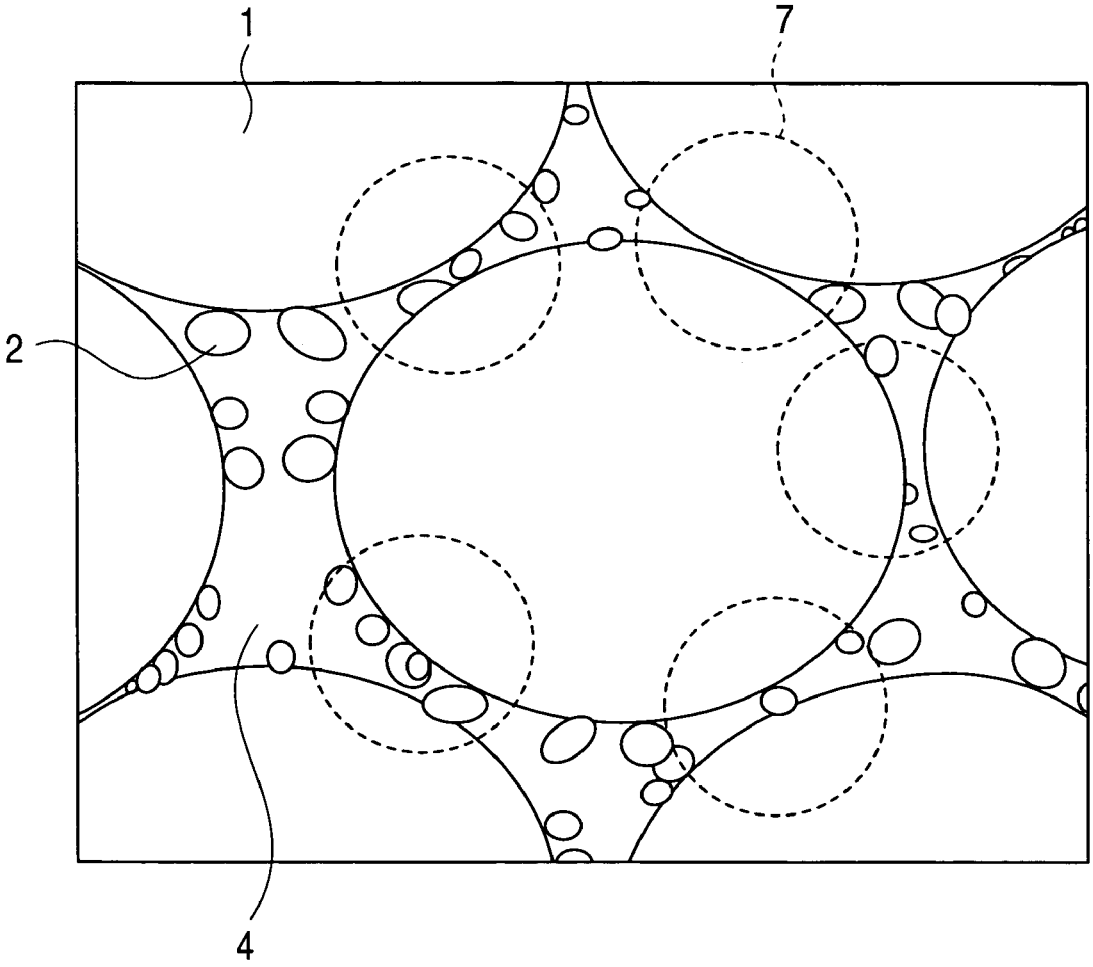
FIG. 5 is a schematic sectional view showing a sintering neck.

The sintering neck is a part wherein the sintering reaction starts at the beginning of the sintering. Specifically, the sintering neck is a part where the compacted alloy steel powders 4 are adjacent to each other. FIG. 5 is a schematic sectional view showing a sintering neck 7. FIG. 5 shows sintering necks relating to only the alloy steel powder 4 disposed at the center of the figure.

In some cases, even in a sintered body produced using the alloy steel powder, which has high rolling contact fatigue strength, a network structure is not recognized. In this case, we believe that a composite structure composed of the Mo-rich phase and the Mo-poor phase is formed. We further believe that, in reality, this composite structure has the same effect (i.e., the characteristic of high rolling contact fatigue strength) as the network structure. Examples of composite structures include a fine network structure, an incomplete network structure, and a partial network structure. These structures are difficult to recognize as the network structure in appearance. However, the composite structure is not limited to the above.

Hereinafter, the term "network structure" that represents the typical structure includes the structures described in the above case. In such a case, although the network structure may not be recognized in appearance, the rolling contact fatigue strength is improved.

The Mo-rich phase 5 is not formed sufficiently when the amount of Mo diffusion bonding is less than about 0.05 mass percent. On the other hand, the sintered body has high strength but the rolling contact fatigue strength decreases when the amount of Mo diffusion bonding exceeds about 0.8 mass percent. This is because the Mo-rich phase 5 becomes embrittle. Accordingly, the amount of Mo diffusion bonding is from about 0.05 to about 0.8 mass percent to the mass of the alloy steel powder 4. In particular, the amount of Mo diffusion bonding is preferably about 0.4 mass percent or less.

Figure 4:
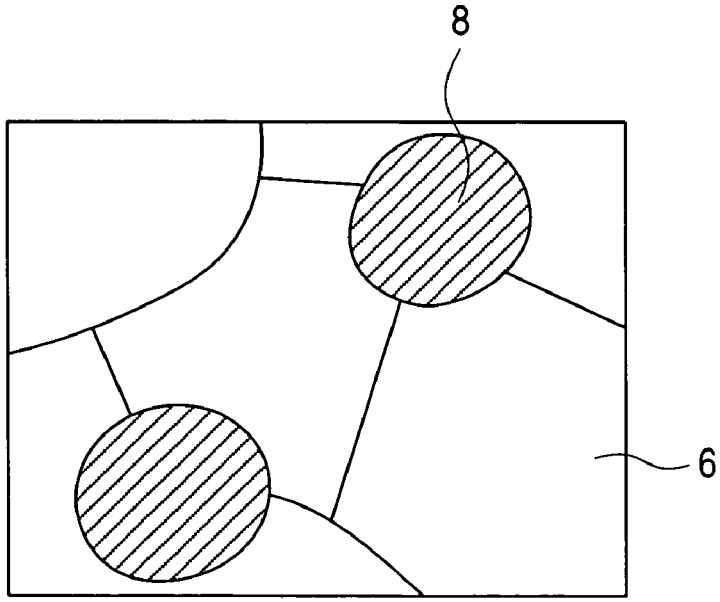
FIG. 4 is a schematic sectional view showing a typical example of a structure of a sintered body wherein a Mo-rich phase is coarsened.

Preferably, the particles of the Mo-containing alloy powder 2 are substantially uniformly bonded on the surface of the iron-based powder 1 by diffusion bonding (or by binder). In the Mo-containing alloy powder 2 unevenly bonded on the iron-based powder 1, the Mo-containing alloy powder 2 readily dissociates from the iron-based powder 1 when the alloy steel powder 4 is crushed after diffusion bonding treatment, or when the alloy steel powder 4 is transported. In such a case, Mo-containing alloy powder in a free state is significantly increased. As shown in FIG. 4, when a green compact composed of such an alloy steel powder is sintered, the dissociated Mo-containing alloy powder 2 aggregates and tends to form a coarse Mo-rich phase 8. The structure of the sintered body is not similar to the network structure represented in FIG. 3. Accordingly, the Mo-containing alloy powder 2 is substantially uniformly bonded on the surface of the iron-based powder 1, thereby decreasing the Mo-containing alloy powder in the free state generated by dissociation from the iron-based powder to increase the rolling contact fatigue strength of the sintered body.

Mo adhesion (i.e., bonding degree of Mo) is introduced as an index for evaluating the uniform bonding property of the Mo-containing alloy powder 2. When calculating this Mo adhesion, a Mo average content (mass percent) $[Mo]_S$ is defined as an average content (mass percent) of Mo that is included in an alloy steel powder for powder metallurgy having a particle diameter of 45 μm or less (hereinafter referred to as fine alloy steel powder). That is, the content $[Mo]_S$ is represented as follows: The fine alloy steel powder having a particle diameter of 45 μm or less is prepared by sieving and classifying an alloy steel powder 4 including an iron-based powder 1 and a Mo-containing alloy powder 2. The total Mo content in the fine alloy steel powder includes the Mo content (mass percent) in the iron-based powder 1 and the Mo content (mass percent) in the Mo-containing alloy powder 2. The Mo average content $[Mo]_S$ is represented by the ratio of the total Mo content (mass percent) in the fine alloy steel powder to the mass of the alloy steel powder 4 (i.e., to the total mass of the fine alloy steel powder). Standard sieves prescribed by JIS Z 8801-1 (2000 edition) are used.

The Mo adhesion is calculated using the $[Mo]_S$ and the Mo average content $[MO]_T$ described above. The Mo adhesion is represented by $[MO]_S/[MO]_T$.

A considerable amount of the Mo-containing alloy powder 2 dissociates from the iron-based powder 1 and aggregates when an alloy steel powder 4 having an Mo adhesion ($=[Mo]_S/[Mo]_T-$) exceeding 1.5 is sintered. Consequently, a coarse Mo-rich phase 8 is readily formed. Therefore, to increase the rolling contact fatigue strength by forming the network structure in the sintered body, as shown in the following formula (5), the Mo adhesion is preferably about 1.5 or less, more preferably, about 1.2 or less:

$$1.5=[Mo]_S/[Mo]_T \quad (5).$$

Formula (5) derives formula (2):

$$1.5[Mo]_T=[Mo]_S \quad (2).$$

A high Mo adhesion ($=[Mo]_S/[Mo]_T$) indicates that the fine alloy steel powder having a particle diameter of 45 μm or less, the fine alloy steel powder being prepared by sieving and classifying, already includes a large amount of Mo-containing alloy powder that is in the free state. On the other hand, the amount of Mo-containing alloy powder that is in the free state is low when the Mo adhesion is close to 1. In such a case, the Mo-containing alloy powder is substantially uniformly bonded on the surface of the iron-based powder. When the Mo-containing alloy powder that is in the free state does not substantially exist, the Mo adhesion should have a lower limit of about 1. However, the lower limit of the Mo adhesion may be substantially 0.9 in view of measurement error and distribution deviation. A large distribution deviation of Mo is not preferred and, therefore, the Mo adhesion is more preferably at least 1.0.

Formula (2) is replaced with the following formula (3) when the Mo adhesion is about 1.2 or less. Furthermore, formula (2) can be replaced with the following formula (4) when the Mo adhesion is at least 1.0:

$$1.2[Mo]_T=[Mo]_S \quad (3)$$

$$1.2[Mo]_T=[Mo]_S=1.0[Mo]_T \quad (4).$$

A preferable characteristic of the rolling contact fatigue is achieved when the Mo-containing alloy powder 2 has an average particle diameter of about 20 μm or less, in particular. The reason for this is as follows: The coarse Mo-rich phase 8 as shown in FIG. 4 is readily formed and the network structure is deteriorated compared with the optimum state when the average particle diameter of the Mo-containing alloy powder 2 exceeds about 20 μm. Accordingly, the Mo-containing alloy powder 2 preferably has an average particle diameter of about 20 μm or less. On the other hand, in view of workability, the Mo-containing alloy powder 2 preferably has an average particle diameter of at least about 1 μm. With regard to the average particle diameter of the Mo-containing powder, the particle size distribution is measured by a laser diffraction scattering method based on JIS R 1629 (1997 edition) and the particle diameter at a cumulative volume fraction of 50% is used as the average particle diameter.

The compressibility or the rolling contact fatigue strength of the sintered body decreases when the content of Mn and Mo in the iron-based powder that is a matrix deviates from the range in the invention, even in the case where the network structure is formed.

On the other hand, addition of elements such as Ni, V, Cu, and Cr is not preferred because compressibility significantly decreases and the rolling contact fatigue strength of the sintered body also decreases due to the decrease in density.

According to the prior art, a Ni-containing powder or a Cu-containing powder, which is used as an element for strengthening as in the case of Mo, is bonded on an iron-based powder by diffusion bonding. However, the diffusion bonding of the above elements does not sufficiently improve the rolling contact fatigue strength. The reason for this is believed to be as follows: Although the above elements can form a network of a Ni-rich phase or a Cu-rich phase, both of the above rich phases significantly lack toughness in view of fatigue.

For the above reason, it is preferred to avoid not only bonding Ni or Cu on the iron-based powder, but also the addition of Ni or Cu as an alloying element in compacting.

In contrast, graphite (or other carbon-containing powder) is effective at increasing the strength and the fatigue strength. Therefore, about 0.1 to about 1.0 mass percent (i.e., the mass ratio of the powder to the mixed alloy steel powder, and so forth) on the basis of carbon of a carbon-containing powder such as graphite powder is preferably added and mixed before compacting. Further, about 0.1 to about 1 mass percent of MnS, for example, may be added as a powder for an alloy before compacting. These powders for an alloy may be bonded on the surface of an iron-based powder to prevent segregation. In terms of cost, diffusion bonding is not suitable and a binder is preferably used. A range of the component represents a mass percent to the total mass including an alloy steel powder and a powder for an alloy after mixing. We concluded that only Mo-containing powder should preferably be used as the alloy bonded by diffusion bonding.

Examples of the impurities in the iron-based powder and the alloy steel powder include C: about 0.02 mass percent or less, O: about 0.2 mass percent or less, N: about 0.004 mass percent or less, Si: about 0.03 mass percent or less, P: about 0.03 mass percent or less, S: about 0.03 mass percent or less, and Al: about 0.03 mass percent or less. Industrially practiced lower limits (rough values) are as follows: C: about 0.001 mass percent, O: about 0.02 mass percent, N: about 0.0001 mass percent, Si: about 0.005 mass percent, P: about 0.001 mass percent, S: about 0.001 mass percent, and Al: about 0.001 mass percent. However, lower limits need not be determined.

As described above, addition of elements such as Ni, V, Cu, and Cr is not preferred. The content of these elements should be at the level as the impurities. Specifically, the content of the elements is preferably as follows: Ni: about 0.03 mass percent or less, V: about 0.03 mass percent or less, Cu: about 0.03 mass percent or less, and Cr: less than 0.02 mass percent. The content of the elements is more preferably as follows: Ni: about 0.02 mass percent or less, V: about 0.02 mass percent or less, Cu: about 0.02 mass percent or less, and Cr: about 0.01 mass percent or less.

In addition to those components described above, the remainder is preferably iron.

Preferable conditions for producing a sintered body using an alloy steel powder for powder metallurgy of the invention will now be described. The details are not described here since the powders for an alloy to be added have already been described. A carbon-containing powder is mainly used as a powder for strengthening and a powder such as MnS is mainly used as a powder to improve the machinability.

In compacting, a powdery lubricant may be mixed with the alloy steel powder and powders for an alloy if any. Further, or alternatively, a lubricant is preferably applied or adhered on the surface of a die. For these purpose, a metallic soap such as zinc stearate and an amide wax such as ethylenebisstearamide are preferably used (but not limited) as the lubricant. The content of the lubricant mixed in the powder is preferably about 0.4 to about 1.2 parts by weight to a total of 100 parts by weight of a powder including an alloy steel powder and powders for an alloy.

The compaction is preferably performed at a pressure of about 400 MPa or more and at a temperature from room temperature (about 20° C.) to about 160° C. The pressure is preferably about 1000 MPa or less. The die may be lubricated during compacting.

Sintering is preferably performed at about 1,100° C. to about 1,300° C. In particular, sintering is preferably performed at about 1,160° C. or less because a mesh belt furnace, which is inexpensive and suitable for mass-production, can be used at this temperature. Sintering is more preferably performed at about 1,140° C. or less. In addition, sintering is preferably performed at about 1,120° C. or more. Of course, other furnaces such as a tray pusher-type sintering furnace or the like may be used.

The resultant sintered body may be subjected to a strengthening treatment such as carburizing and quenching (CQT), bright-quenching (BQT), high-frequency quenching, or carbonitriding treatment according to needs. Even if such a strengthening treatment is not performed, the rolling contact fatigue strength of the sintered body is improved compared with that of a known sintered body (without such a strengthening treatment). Tempering may be further performed after quenching.

The strengthening treatment is performed by a known method. Carburizing is preferably performed in a carbon potential of about 0.6% to about 1.2% and at about 800° C. to about 950° C. Subsequently, the resultant sintered body is preferably quenched to about 60° C. or less (wherein both water quenching and oil quenching may be performed). The carbon potential refers to a carburizing ability of an atmosphere in which steel is heated. The carbon potential represents the carbon content (mass percent) on the surface of the steel wherein the steel is equilibrated with a gas atmosphere in the carburizing at the carburizing temperature.

A preferred method and conditions for bright-quenching is disclosed, for example, in paragraph number [0031] in Japanese Unexamined Patent Application Publication No. 2001-181701.

High-frequency induction heating is performed in high-frequency quenching such that the temperature of the surface of a sintered body reaches about 850° C. to about 1,100° C. Subsequently, the resultant sintered body is preferably quenched to about 60° C. or less (wherein both water quenching and oil quenching may be performed).

Carbonitriding is preferably performed in a carbon potential of about 0.6% to about 1.2% in an atmosphere containing about 3% to about 10% (volume percent) of ammonia gas at about 750° C. to about 950° C. Subsequently, the resultant sintered body is preferably quenched to about 60° C. or less (wherein both water quenching and oil quenching may be performed).

The resultant sintered body preferably contains the following components: C: about 0.6 to about 1.2 mass percent, O: about 0.02 to about 0.15 mass percent, and N: about 0.001 to about 0.7 mass percent. Regarding components other than C, O, and N, the composition is almost the same as that of the mixed powder (i.e., the alloy steel powder and the powder for an alloy mixed therein) before compaction.

As described above, a technology is known in which Mo is added independently or with another element such as Ni to improve the strength of the sintered body. In particular, in view of compressibility, various amounts of Mo are added as a prealloy or are bonded by diffusion bonding, or a combination of prealloy and diffusion bonding. However, Mo is independently added without combining another element such as Ni, in addition, an appropriate amount of prealloy and diffusion bonding is combined. Thus, the rolling contact fatigue strength of the sintered body can be improved. Such an improvement cannot be expected from the known technology disclosed in Japanese Unexamined Patent Application Publication Nos. 2003-147405, 2002-146403, 7-51721 and the like.

The mixed powder was heated in a hydrogen atmosphere having a dew point of 25° C. (retention temperature: 900° C., except for Sample No. 13: 800° C., Sample No. 14: 700° C. to vary Mo adhesion; retention time: 1 hour). Thus, the $MoO_3$ powder was reduced to Mo metal powder and the resultant Mo powder was bonded on the surface of an iron-based powder by diffusion bonding to produce alloy steel powders for powder metallurgy. The alloy steel powders for powder metallurgy were sampled and the Mo content $[Mo]_T$ was measured. Table 1 shows the results. All of the alloy steel powders for powder metallurgy had an average particle diameter of 70 to 90 μm.

With regard to the particle diameter of the iron-based powder and the alloy steel powder, the particle size distribution was measured by a method for sieving described in JIS Z 8815 (1994 edition) and the particle diameter at a cumulative undersize percentage (mass basis) of 50% was used as the average particle diameter.

The remaining components of the resultant alloy steel powder included iron and inevitable impurities (C: 0.001 to 0.006 mass percent, Si: 0.008 to 0.015 mass percent, P: 0.006 to 0.010 mass percent, S: 0.008 to 0.012 mass percent, Al: 0.010 to 0.015 mass percent, N: 0.0006 to 0.0018 mass percent, and O: 0.09 to 0.15 mass percent).

TABLE 1

| | Alloy steel powder for powder metallurgy | | | | | | Sintered body | | |
|---|---|---|---|---|---|---|---|---|---|
| | Iron-based powder | | | | | | | | |
| Sample No. | $[Mo]_P$ (mass percent) | Prealloyed Mn content (mass percent) | Amount of Mo diffusion bonding* (mass percent) | $[Mo]_T$ (mass percent) | $[Mo]_S$ (mass percent) | Mo adhesion $[Mo]_S/[Mo]_T$ | Density ($Mg/m^3$) | Rolling contact fatigue strength (GPa) | Remark |
| 1 | 0.62 | 0.21 | 0 | 0.62 | — | — | 7.37 | 2.9 | Comparative Example |
| 2 | 0.62 | 0.21 | 0.2 | 0.82 | 0.83 | 1.01 | 7.36 | 3.9 | Example |
| 3 | 0.62 | 0.21 | 0.6 | 1.22 | 1.24 | 1.02 | 7.34 | 3.8 | |
| 4 | 0.62 | 0.21 | 0.8 | 1.42 | 1.46 | 1.03 | 7.34 | 3.8 | |
| 5 | 0.62 | 0.21 | 1.2 | 1.82 | 1.85 | 1.02 | 7.32 | 2.9 | Comparative Example |
| 6 | 0.21 | 0.19 | 0.4 | 0.61 | 0.66 | 1.08 | 7.38 | 3.9 | Example |
| 7 | 0.62 | 0.2 | 0.4 | 1.02 | 1.11 | 1.09 | 7.35 | 3.8 | |
| 8 | 1.03 | 0.21 | 0.4 | 1.43 | 1.56 | 1.09 | 7.34 | 3.6 | |
| 9 | 1.45 | 0.2 | 0.4 | 1.85 | 2.06 | 1.11 | 7.33 | 3.5 | |
| 10 | 1.79 | 0.19 | 0.4 | 2.19 | 2.50 | 1.14 | 7.26 | 2.9 | Comparative |
| 11 | 0.59 | 0.56 | 0.4 | 0.99 | 1.05 | 1.06 | 7.22 | 2.5 | Example |
| 12 | 0.31 | 0.20 | 0.2 | 0.51 | 0.52 | 1.02 | 7.36 | 3.9 | Example |
| 13 | 0.31 | 0.20 | 0.2 | 0.51 | 0.68 | 1.33 | 7.35 | 3.3 | |
| 14 | 0.31 | 0.20 | 0.2 | 0.51 | 0.81 | 1.59 | 7.32 | 3.1 | |
| 20 | 0.10 | 0.20 | 0.2 | 0.30 | 0.31 | 1.03 | 7.38 | 2.9 | Comparative Example |
| 21 | 0.62 | 0.45 | 0.15 | 0.77 | 0.80 | 1.04 | 7.33 | 3.5 | Example |

*Amount of Mo diffusion bonding = $[Mo]_T - [Mo]_P$

EXAMPLES

We now provide Examples. An alloy steel powder and the application thereof are not limited to the following examples.

Example 1

Molten steel containing predetermined amounts of Mo and Mn was atomized by water atomization to produce an iron-based as-atomized powder. $MoO_3$ powder (average particle diameter 2.5 μm) was added to this iron-based powder as a raw Mo powder at a predetermined ratio, and then mixed with a V-type mixer for 15 minutes.

In Table 1, a prealloyed Mo content $[Mo]_P$ (mass percent), a prealloyed Mn content (mass percent), and an amount of Mo diffusion bonding ($=[Mo]_T-[Mo]_P$) (mass percent) are values relative to the mass of the alloy steel powder for powder metallurgy.

These alloy steel powders for powder metallurgy were sieved to classify fine alloy steel powders having a particle diameter of 45 μm or less. The fine alloy steel powders were sampled, and the Mo content ($[Mo]_S$) in the fine alloy steel powders was measured.

Sample Nos. 2 to 4, 6 to 9, 12 to 14, and 21 are examples wherein the prealloyed Mo content, the prealloyed Mn content, and the amount of Mo diffusion bonding satisfy the range of the invention. Sample Nos. 1 and 5 are examples wherein the amount of Mo diffusion bonding (=($[Mo]_T$−$[Mo]_P$) is not within the range of the invention. Sample Nos. 10 and 20 are examples wherein the prealloyed Mo content is not within the range of the invention. Sample No. 11 is an example wherein the prealloyed Mn content is not within the range of the invention.

Subsequently, a die for compaction was heated to 130° C. Lithium stearate was atomized on the inner surface of the die with a device produced by Nordson KK disclosed in Japanese Unexamined Patent Application Publication No. 2002-327204. Thus, lithium stearate was adhered by charging to the inner surface of the die.

Furthermore, 0.5 mass percent of-graphite and 0.2 parts by weight of lithium stearate were added to the alloy steel powders for powder metallurgy used in Sample Nos. 1 to 14, 20 and 21, and the mixtures were then mixed with a V-type mixer for 15 minutes. Subsequently, the mixture was heated to 130° C. and filled in the die. The mixture was compacted at a pressure of 686 MPa to form a tablet green compact having a diameter of 60 mm and a thickness of 6 mm.

The tablet green compact was sintered to form a sintered body. The sintering was performed in an RX gas atmosphere ($N_2$—32 volume percent of $H_2$—24 volume percent of CO—0.3 volume percent of $CO_2$) at 1,130° C. for 20 minutes. The resultant sintered body was subjected to gas carburizing (retention temperature: 870° C., retention time: 60 minutes) in a carbon potential of 0.8%. The resultant sintered body was then quenched (oil quenching at 60° C.) and tempered (at 200° C. for 60 minutes).

Regarding the composition of the sintered body, the total carbon content was slightly increased based on the fact that the carbon content on the surface of the sintered body was increased to the range of 0.75 to 0.8 mass percent. The oxygen content was slightly decreased to the range of 0.05 to 0.12 mass percent, the nitrogen content was slightly increased to the range of 0.01 to 0.02 mass percent. The composition of other components was almost the same as that of the raw material.

The density ($Mg/m^3$) and the rolling contact fatigue strength (GPa) of the sintered body were measured. The results are also shown in Table 1. The rolling contact fatigue strength was measured by performing a six bail-type rolling contact fatigue test. The rolling contact fatigue strength represents a maximum contact stress calculated from a load in which pitting was not formed after $10^7$ times. The formation of pitting was confirmed with an acceleration-type vibration monitoring device. When the acceleration exceeded 0.7 G, the device determined that pitting had formed.

The rolling contact fatigue test was performed with a six ball-type rolling contact fatigue tester (i.e., a Mori-type rolling contact fatigue strength tester). A disc test piece having an outer diameter of 60 mm and a thickness of 6 mm was used in the test. In the test, six steel balls wherein a load was applied were rolled on the surface of the test piece. A load at which the test could be repeated $10^7$ times without pitting was defined as a fatigue load limit. The maximum contact stress, which was defined as the rolling contact fatigue strength, was calculated according to formula (6). Young's modulus of the sintered body was defined as formula (7), wherein the Young's modulus depended on the density:

$$sW=0.62[P(EE')^2/r^2(E+E')^2]^{1/3} \quad (6)$$

sW: maximum contact stress (GPa)

P: load on test steel ball (N)

r: radius of test steel ball (4.7625 mm)

E: Young's modulus of test steel ball (210 GPa)

E': Young's modulus of sintered body (GPa)

$$E'=-342+69.2\rho \quad (7)$$

ρ: density of sintered body ($Mg/m^3$).

In a comparison of Examples (Sample Nos. 2 to 4, 6 to 9, 12 to 14, and 21) with Comparative Examples (Sample Nos. 1, 5, 10, 11, and 20), the rolling contact fatigue strength in Examples was 3.1 to 3.9 GPa, whereas the rolling contact fatigue strength in the Comparative Examples was 2.5 to 2.9 GPa. Accordingly, using the alloy steel powder increases the rolling contact fatigue strength of the sintered body.

Sample No. 14, wherein the Mo adhesion (i.e., $[Mo]_S/[Mo]_T$) exceeded 1.5, win now be compared with Sample Nos. 2 to 4, 6 to 9, 12, 13, and 21, wherein the Mo adhesion was 1.5 or less. The rolling contact fatigue strength of the Sample No. 14 was 3.1 GPa, whereas the rolling contact fatigue strength of the Sample Nos. 2 to 4, 6 to 9, 12, 13, and 21 was 3.3 to 3.9 GPa Accordingly, the Mo adhesion was preferably controlled to about 1.5 or less (i.e., in the range that satisfies formula (2)), thereby achieving high rolling contact fatigue strength. Furthermore, the rolling contact fatigue strength of Sample No. 12, wherein the Mo adhesion was less than about 1.2, was significantly improved compared with that of Sample No. 13, having the same composition and wherein the Mo adhesion exceeded about 1.2. Referring to Table 1, even if the variation in the composition was considered, when the Mo adhesion was about 1.1 or less, the rolling contact fatigue strength was at least 3.5 GPa (see Sample No. 9).

Example 2

Molten steel containing predetermined amounts of Mo and Mn was atomized by water atomization. Subsequently, the atomized powder was reduced in a hydrogen atmosphere. Furthermore, the powder was crushed to produce an iron-based powder. Molybdenum metal powder (purity: 99.9%, average particle diameter: 5 μm) was added as a Mo-containing alloy powder to the iron-based powder at a predetermined ratio. In addition, 1.0 mass percent of zinc stearate was added as a binder to the mixed powder. The mixture was heated at 140° C. for 15 minutes. The Mo metal powder was bonded on the surface of the iron-based powder by binder bonding to produce alloy steel powders for powder metallurgy. The content of zinc stearate (mass percent) represents a ratio of the mass of the zinc stearate to the total mass (i.e., the mass of the alloy steel powder for powder metallurgy) including the iron-based powder and the Mo metal powder.

The rest of the components of the resultant alloy steel powder were the same as in Example 1.

The steps of compacting to tempering were performed using these alloy steel powders as in Example 1 to produce the sintered body. The density and the rolling contact fatigue strength of the sintered body were measured. Table 2 shows the results.

TABLE 2

| | Alloy steel powder for powder metallurgy | | | | | | Sintered body | | |
|---|---|---|---|---|---|---|---|---|---|
| | Iron-based powder | | | | | | | | |
| Sample No. | $[Mo]_P$ (mass percent) | Prealloyed Mn content (mass percent) | Additional amount of Mo metal powder** (mass percent) | $[Mo]_T$ (mass percent) | $[Mo]_S$ (mass percent) | Mo adhesion $[Mo]_S/[Mo]_T$ | Density ($Mg/m^3$) | Rolling contact fatigue strength (GPa) | Remark |
| 15 | 0.82 | 0.2 | 0 | 0.82 | — | — | 7.35 | 2.8 | Comparative Example |
| 16 | 0.82 | 0.2 | 0.2 | 1.02 | 1.04 | 1.02 | 7.35 | 3.7 | Example |
| 17 | 0.82 | 0.2 | 0.6 | 1.42 | 1.43 | 1.02 | 7.33 | 3.6 | |
| 18 | 0.82 | 0.2 | 0.8 | 1.62 | 1.69 | 1.04 | 7.32 | 3.5 | |
| 19 | 0.82 | 0.2 | 1.2 | 2.02 | 2.12 | 1.05 | 7.31 | 2.6 | Comparative Example |

**Additional amount of Mo metal powder = $[Mo]_T - [Mo]_P$

Sample Nos. 16 to 18 are examples wherein the prealloyed Mo content, the prealloyed Mn content, and the additional amount of Mo metal powder (=($[Mo]_T$−$[Mo]_P$) satisfy the range of the invention. Sample Nos. 15 and 19 are examples wherein the additional amount of Mo metal powder was not within the range of the invention.

In a comparison of Examples (Sample Nos. 16 to 18) with Comparative Examples (Sample Nos. 15 and 19), although the density of the sintered bodies in the Examples was equivalent to that in the Comparative Examples, the rolling contact fatigue strength in the Examples was higher than that in the Comparative Examples.

However, when the Mo adhesion was the same, the Examples (Sample Nos. 2 to 4) produced by diffusion bonding described in Example 1 had a rolling contact fatigue strength higher than that in the Examples produced by binder bonding described in Example 2.

Example 3

Alloy steel powders shown in Table 3 were produced as in Example 1. The compacting, sintering, and subsequent strengthening treatments were performed as in Example 1. The characteristics of the sintered body were evaluated with the same methods. Table 3 shows the results. Only the following conditions were changed in the samples.

Sample Nos. 22 and 23: Molybdenum metal powder (No. 22) as in Example 2 and ferromolybdenum powder (composition: substantially 60 mass percent of Mo-Fe, particle diameter: 3.5 μm) (No. 23) were used as a raw Mo powder instead of $MoO_3$ powder. Although Sample Nos. 22 and 23 were not reduced, the bonding treatment was performed under the same condition as in Example 1.

Sample No. 24: Before the powder was filled in a die, mixing was performed under the following conditions. Graphite (0.3 mass percent), MnS (0.5 mass percent), which was a powder to improve the machinability, and ethylenebisstearamide (0.6 parts by weight), which was a lubricant, were further added to the alloy steel powder and then mixed with a V-type mixer for 15 minutes. The die was not lubricated to compact Sample No. 24.

The resultant alloy steel powders of Sample Nos. 22 to 24 had a particle diameter of 80 to 90 μm. The content of impurities in the alloy steel powders was the similar level as in Example 1. The composition of the sintered bodies was also similar to in Example 1 except for the components added to Sample No. 24 (almost the same as the added amount).

Sample No. 25: Bright-quenching was performed after sintering under the following conditions instead of carburizing and quenching. The sintered body was heated at 900° C. for 60 minutes in argon gas, and then quenched to 60° C. by oil quenching. Subsequently, the resultant sintered body was tempered at 180° C. for 60 minutes. The content of graphite, which was mixed before the alloy steel powder was filled in the die, was 0.8 mass percent. The conditions for lubrication (i.e., the lubricant to be mixed and the lubrication of the die) were as in Sample No. 24.

Sample No. 26: High-frequency quenching was performed after sintering under the following conditions instead of carburizing and quenching. The sintered body was heated up to 900° C. at the frequency of 10 kHz, and then quenched into water at room temperature.

Subsequently, the resultant sintered body was tempered at 180° C. for 60 minutes. The content of graphite, which was mixed before the alloy steel powder was filled in the die, was 0.8 mass percent. The conditions for lubrication (i.e., the lubricant to be mixed and the lubrication of the die) were as in Sample No. 24.

Sample No. 27: Carbonitriding treatment was performed after sintering under the following conditions instead of carburizing and quenching. The sintered body was heated at 860° C. for 60 minutes in a carbon potential of 0.8% in an atmosphere containing 5 volume percent of ammonia. The resultant sintered body was then quenched to 60° C. by oil quenching. Subsequently, the resultant sintered body was tempered at 180° C. for 60, minutes. The content of graphite, which was mixed before the alloy steel powder was filled in the die, was 0.15 mass percent. The conditions for lubrication (i.e., the lubricant to be mixed and the lubrication of the die) were as in Sample No. 24.

The resultant alloy steel powders of Sample Nos. 25, 26, and 27 had a particle diameter of 80 to 90 μm. The content of impurities in the alloy steel powders was similar to in Example 1. Regarding the composition of the sintered body, the carbon content of Sample Nos. 25 and 26 was 0.7 to 0.75 mass percent, and the nitrogen content of Sample No. 27 was 0.45 to 0.5 mass percent. Total carbon content of Sample No. 27 was slightly-increased based on the fact that the carbon content on the surface of the sintered body was increased to in the range of 0.15 to 0.8 mass percent. The composition of other components was similar to Example 1.

TABLE 3

| | Alloy steel powder for powder metallurgy | | | | | | Sintered body | | |
|---|---|---|---|---|---|---|---|---|---|
| | Iron-based powder | | | | | | | | |
| Sample No. | $[Mo]_P$ (mass percent) | Prealloyed Mn content (mass percent) | Amount of Mo diffusion bonding** (mass percent) | $[Mo]_T$ (mass percent) | $[Mo]_S$ (mass percent) | Mo adhesion $[Mo]_S/[Mo]_T$ | Density ($Mg/m^3$) | Rolling contact fatigue strength (GPa) | Remark |
| 22 | 0.70 | 0.2 | 0.2 | 0.9 | 1.01 | 1.12 | 7.35 | 3.5 | Example |
| 23 | 0.51 | 0.08 | 0.6 | 1.11 | 1.22 | 1.10 | 7.37 | 3.7 | |
| 24 | 0.42 | 0.10 | 0.4 | 0.82 | 0.83 | 1.01 | 7.32 | 3.5 | |
| 25 | 1.20 | 0.08 | 0.3 | 1.50 | 1.53 | 1.02 | 7.33 | 3.2 | |
| 26 | 0.84 | 0.32 | 0.5 | 1.34 | 1.40 | 1.04 | 7.33 | 3.2 | |
| 27 | 0.60 | 0.10 | 0.3 | 0.9 | 0.91 | 1.01 | 7.34 | 3.5 | |

**Amount of Mo diffusion bonding = $[Mo]_T - [Mo]_P$

Referring to Table 3, in Sample Nos. 24 to 27, wherein the die was not lubricated and an increased amount of lubricant was mixed instead, the density of the sintered body was slightly decreased. According to Sample Nos. 25 an 26 wherein bright-quenching or high-frequency quenching was performed, the absolute values of rolling contact fatigue strength were slightly decreased compared with other samples wherein carburizing and quenching, or carbonitriding treatment was performed. In any case, however, application of an alloy steel powder of the invention provides significant improvement compared to known powders.

What is claimed is:

1. An alloy steel powder for powder metallurgy comprising:

an iron-based powder containing about 0.5 mass percent or less of Mn as a prealloyed element and 0.2 to about 1.5 mass percent of Mo as a prealloyed element; and Mo-containing alloy powder bonded on surfaces of the iron-based powder, wherein a Mo average content $[Mo]_T$ (mass percent) satisfies formula (1):

$$0.8 \geqq [Mo]_T - [Mo]_P \geqq 0.05 \quad (1)$$

wherein $[Mo]_P$ is the prealloyed Mo content (mass percent) in the iron-based powder and the alloy steel powder contains about 0.03 mass percent or less of Ni and about 0.03 mass percent or less of V.

2. An alloy steel powder for powder metallurgy comprising:

an iron-based powder containing about 0.5 mass percent or less of Mn as a prealloyed element and 0.2 to about 1.5 mass percent of Mo as a prealloyed element; and Mo-containing alloy powder bonded on surfaces of the iron-based powder by diffusion bonding, wherein a Mo average content $[Mo]_T$ (mass percent) satisfies formula (1):

$$0.8 \geqq [Mo]_T - [Mo]_P \geqq 0.05 \quad (1)$$

wherein $[Mo]_P$ is the prealloyed Mo content (mass percent) in the iron-based powder and the alloy steel powder contains about 0.03 mass percent or less of Ni and about 0.03 mass percent or less of V.

3. The alloy steel powder for powder metallurgy according to claim 2, where-in the Mo-containing alloy powder is produced by reducing a Mo-containing compound mixed with the iron-based powder.

4. An alloy steel powder for powder metallurgy comprising:

an iron-based powder containing about 0.5 mass percent or less of Mn as a prealloyed ele-ment and 0.2 to about 1.5 mass percent of Mo as a prealloyed element; and Mo-containing alloy powder bonded on surfaces of the iron-based powder with a binder, wherein a Mo average content $[Mo]_T$ (mass percent) satisfies formula (1):

$$0.8 \geqq [Mo]_T - [Mo]_P \geqq 0.05 \quad (1)$$

wherein $[Mo]_P$ is the prealloyed Mo content (mass percent) in the iron-based powder and the alloy steel powder contains about 0.03 mass percent or less of Ni and about 0.03 mass percent or less of V.

5. The alloy steel powder according to claim 1, wherein a Mo average content $[Mo]_S$ (mass percent) in an alloy steel powder having a particle diameter of 45 μm or less satisfies formula (2):

$$1.5[Mo]_T \geqq [Mo]_S \quad (2).$$

6. The alloy steel powder according to claim 2, wherein a Mo average content $[Mo]_S$ (mass percent) in an alloy steel powder having a particle diameter of 45 μm or less satisfies formula (2):

$$1.5[Mo]_T \geqq [Mo]_S \quad (2).$$

7. The alloy steel powder according to claim 3, wherein a Mo average content $[Mo]_S$ (mass percent) in an alloy steel powder having a particle diameter of 45 μm or less satisfies formula (2):

$$1.5[Mo]_T \geqq [Mo]_S \quad (2).$$

8. The alloy steel powder according to claim 4, wherein a Mo average content $[Mo]_S$ (mass percent) in an alloy steel powder having a particle diameter of 45 μm or less satisfies formula (2):

$$1.5[Mo]_T \geqq [Mo]_S \quad (2).$$

9. The alloy steel powder according to claim 1, wherein a Mo average content $[Mo]_S$ (mass percent) in an alloy steel powder having a particle diameter of 45 μm or less satisfies formula (3):

$$1.2[Mo]_T \geqq [Mo]_S \quad (3).$$

10. The alloy steel powder according to claim 2, wherein a Mo average content $[Mo]_S$ (mass percent) in an alloy steel powder having a particle diameter of 45 μm or less satisfies formula (3):

$$1.2[Mo]_T \geqq [Mo]_S \quad (3).$$

11. The alloy steel powder according to claim 3, wherein a Mo average content $[Mo]_S$ (mass percent) in an alloy steel powder having a particle diameter of 45 μm or less satisfies formula (3):

$$1.2[Mo]_T \geqq [Mo]_S \quad (3).$$

12. The alloy steel powder according to claim 4, wherein a Mo average content $[Mo]_S$ (mass percent) in an alloy steel powder having a particle diameter of 45 μm or less satisfies formula (3):

$$1.2[Mo]_T \geqq [Mo]_S \quad (3).$$

13. The alloy steel powder according to claim 1, wherein a Mo average content $[Mo]_S$ (mass percent) in an alloy steel powder having a particle diameter of 45 μm or less satisfies formula (4):

$$1.2[Mo]_T \geqq [Mo]_S \geqq 1.0[Mo]_T \quad (4).$$

14. The alloy steel powder according to claim 2, wherein a Mo average content $[Mo]_S$ (mass percent) in an alloy steel powder having a particle diameter of 45 μm or less satisfies formula (4):

$$1.2[Mo]_T \geqq [Mo]_S \geqq 1.0[Mo]_T \quad (4).$$

15. The alloy steel powder according to claim 3, wherein a Mo average content $[Mo]_S$ (mass percent) in an alloy steel powder having a particle diameter of 45 μm or less satisfies formula (4):

$$1.2[Mo]_T \geqq [Mo]_S \geqq 1.0[Mo]_T \quad (4).$$

16. The alloy steel powder according to claim 4, wherein a Mo average content $[Mo]_S$ (mass percent) in an alloy steel powder having a particle diameter of 45 μm or less satisfies formula (4):

$$1.2[Mo]_T \geqq [Mo]_S \geqq 1.0[Mo]_T \quad (4).$$

17. The alloy steel powder according to claim 1, comprising about 0.02 to about 0.5 mass percent of Mn as the prealloying element.

18. The alloy steel powder according to claim 2, comprising about 0.02 to about 0.5 mass percent of Mn as the prealloying element.

19. A sintered body comprising:

a Mo-poor phase comprising an iron-based phase containing about 0.5 mass percent or less of Mn and 0.2 to about 1.5 mass percent of Mo as prealloyed elements; and a network shaped Mo-rich phase comprising an Mo containing alloy phase formed at peri-pheries of the Mo-poor phase, wherein a Mo average content $[Mo]_T$ (mass percent) satisfies formula (1):

$$0.8 \geqq [Mo]_T - [Mo]_P \geqq 0.05 \quad (1)$$

wherein $[Mo]_P$ is the prealloyed Mo content (mass percent) in the iron-based phase and the sintered body contains about 0.03 mass percent or less of Ni and about 0.03 mass percent or less of V.

20. The sintered body according to claim 19, comprising about 0.02 to about 0.5 mass percent of Mn as the prealloying element.

21. The sintered body according to claim 19, wherein the network shaped Mo-rich phase is formed during sintering by forming a single α phase at sintering necks located where compacted alloy steel powder particles are adjacent one another.

22. The sintered body according to claim 21, wherein presence of the α phase accelerates sintering and reinforces the sintering necks, thereby increasing rolling contact fatigue strength.

23. The sintered body according to claim 21, wherein the network shaped Mo-rich phase is a partial network.

24. The sintered body according to claim 21, wherein the network shaped Mo-rich phase is a fine network.

25. The alloy steel powder according to claim 1, wherein the alloy steel powder contains about 0.03 mass percent or less of Cu and less than 0.02 mass percent of Cr.

26. The alloy steel powder according to claim 1, wherein the alloy steel powder contains about 0.02 mass percent or less of Ni, about 0.02 mass percent or less of V, about 0.02 mass percent or less of Cu and about 0.01 mass percent or less of Cr.

* * * * *